US005730206A

United States Patent [19]

Gerding

[11] Patent Number: 5,730,206

[45] Date of Patent: Mar. 24, 1998

[54] CONTINUOUS STRIP CASTING MOLD FORMED OF PLATE ELEMENTS

[76] Inventor: Charles C. Gerding, 8428 Wiese Rd., Brecksville, Ohio 44141

[21] Appl. No.: 784,708

[22] Filed: Jan. 16, 1997

Related U.S. Application Data

[63] Continuation-in-part of Ser. No. 426,708, Apr. 24, 1995, Pat. No. 5,620,045 and a continuation of PCT/US96/04853, Apr. 24, 1996.

[51] Int. Cl.[6] ..... B22D 11/06

[52] U.S. Cl. ..... 164/430; 164/479

[58] Field of Search ..... 164/430, 431, 164/479

[56] References Cited

U.S. PATENT DOCUMENTS

| | | | |
|---|---|---|---|
| 49,053 | 7/1865 | Bessemer . | |
| 2,383,310 | 8/1945 | Hazelett . | |
| 2,450,428 | 10/1948 | Hazelett . | |
| 2,560,639 | 7/1951 | Giesler et al. | 164/430 X |
| 2,564,723 | 8/1951 | Rossi . | |
| 3,336,973 | 8/1967 | Ratcliffe . | |
| 3,345,738 | 10/1967 | Mizikar et al. | 29/528 |
| 3,437,128 | 4/1969 | Poppmeier . | |
| 3,570,586 | 3/1971 | Lavener | 164/430 |
| 3,627,025 | 12/1971 | Tromel et al. . | |
| 3,747,666 | 7/1973 | Gyongyos . | |
| 3,773,102 | 11/1973 | Gerding . | |
| 4,617,980 | 10/1986 | Banninger | 164/430 |
| 4,682,646 | 7/1987 | Hulek | 164/481 |
| 4,716,955 | 1/1988 | Fastert | 164/475 |
| 4,770,228 | 9/1988 | Artz et al. | 164/430 |
| 4,811,779 | 3/1989 | Streubel et al. | 164/418 |
| 4,926,930 | 5/1990 | Gay et al. | 164/476 |
| 4,951,734 | 8/1990 | Hoffken et al. | 164/455 |
| 4,953,615 | 9/1990 | Hulek | 164/417 |
| 5,133,401 | 7/1992 | Cisko et al. | 164/430 |
| 5,137,075 | 8/1992 | Gerding | 164/263 |

FOREIGN PATENT DOCUMENTS

| | | | |
|---|---|---|---|
| 0237318 | 9/1987 | European Pat. Off. | 164/430 |
| 61-140353 | 6/1986 | Japan | 164/430 |
| 62-207536 | 9/1987 | Japan | 164/430 |
| 62-244555 | 10/1987 | Japan | 164/430 |

OTHER PUBLICATIONS

Article "Advances in Strip–Casting Carbon and Stainless" New Steel Nov. 1996, this article cites processes extant that would compete with subj. invention—a mold of plate elements is not cited, pp. 68–72, 74 and 76.

Samways, N.L. "Nucor Steel, Hickman—2.2 Million Ton/Year Flat Rolled Minimill" Iron & Steel Engineer—Apr. 1994, pp. 77–84.

Kruger & Streubel "CPR—A Combined Casting/Rolling Process for Producing Steel Strip" Iron & Steel Engineer—May 1995, pp. 31–36.

*Primary Examiner*—J. Reed Batten, Jr.

[57] ABSTRACT

The machine has a vertically oriented open-topped mold cavity having downwardly moving containment surfaces that hold a pool of liquid metal. The cavity is wide at the top-center and tapers to the narrow thickness of the strip (34) being cast at the edges of the sides and at the bottom. The two wide sides of the cavity are each delineated by a matrix of contiguous plates (38) separated by narrow fissures, the surface of each plate being subdivided by narrow expansion joints. Each matrix is a many-facetted approximation of a doubly-curved surface, the dynamic changes in the shape of which being facilitated by small changes in the relative linear and angular orientation of the plates with each other as they proceed downwardly through the matrix. A plate supporting arrangement with arcuately grooved tracks precludes lateral shifting of the plates of a given column with respect to each other and provision is made for adjusting both the thickness and the width of the casting.

16 Claims, 12 Drawing Sheets

CONTINUOUS STRIP CASTING MOLD FORMED OF PLATE ELEMENTS

This is a continuation-in-part application of U.S. patent application Ser. No. 08/426,708 filed Apr. 24, 1995, and now U.S. Pat. No. 5,620,045 and a continuation of PCT/US96/04853 filed Apr. 24, 1996.

FIELD OF INVENTION

This invention relates to the general field of apparatus for the continuous casting of metal strip between two downwardly moving and converging casting surfaces each formed of a number of articulated columns of casting chill elements of what may be called the caterpillar type. A plurality of columns of these elements form a two dimensional matrix of these elements on each side of the machine which, along with downwardly moving containment surfaces at the edges constrain a casting pool that is wide at the top center and tapers to a constant width at the edges of the sides and at the bottom. Each casting element is comprised one or more small nested blocks separated by fissures. The edges of the blocks may be chamfered. Means are provided to modify the casting profile and to adjust the width of the casting.

DESCRIPTION OF PRIOR ART

Current production methods employ continuous casting in the manufacture of flat-rolled steel. Most of this material is cast from the liquid metal into slabs of from 150 to 350 millimeters in thickness using stationary albeit oscillating molds having a casting cavity of constant or slightly converging cross-section from top to bottom. Solidification is not complete in the mold and the slab exits the bottom with a liquid center. The slab is then conveyed downward at a constant velocity between a number of constraining conveyor rolls and is sprayed with water until it is fully solidified.

Such molds must be wide enough to receive a pouring tube or shroud which carries liquid metal from an overhead tundish into the mold, the bottom end of this tube being immersed in the liquid pool at the top of the mold. The minimum thickness that can be cast must be greater than the diameter of the pouring tube.

The fully solidified slab is subsequently reheated and rolled down to a so-called hot-band of fractional inch thickness, these operations requiring a considerable expenditure of energy with expensive equipment.

In recent years thin-slab casting has come into use in which slabs of 50 millimeters or so in thickness are produced, resulting in great savings over the earlier methods. This has been made possible by an oscillating mold design, the casting cavity of which is flared out in the center region of the top to accommodate the hot metal pouring tube, and which is tapered inwardly from top to bottom as well as from the center to the sides so that the thickness of the emerging slab is of a smaller dimension than the pouring tube diameter.

It has long been known that the direct casting of steel strip of only a few millimeters thickness would result in even greater savings, both in initial investment and in operating cost and would give a better internal structure of the cast metal than is obtained by the slower freezing required in the thicker casting processes. Such fast freezing can enhance the mechanical properties of the cast material and decrease or even obviate subsequent rolling for some product applications.

The devices which have been proposed for thin casting usually involve either a single moving mold surface onto which liquid metal is evenly distributed or two opposed moving surfaces with a pool of metal being frozen between them, the ends of the pool being constrained by various means. In the latter case, the two surfaces may be either parallel to each other or may converge from a wide to a narrow gap. Such devices have come to be called strip casting machines.

The single-sided devices generally yield a very thin strip at high speed, or a thicker strip at a much lower speed, one side of which tends to be rough in surface texture.

Of the two sided devices with parallel casting surfaces, the two cast sheets grow into each other and solidify as one strip. However, effective means for feeding liquid steel into a wide and thin gap have not yet been found, and casters of this type have been limited to the casting of thicker steel slabs or thinner strip of lower melting metals.

A type of machine which may be thought of as a hybrid uses a constant or converging gap mold in a first stage to form a thin-walled cast shell with a liquid center, after which the two wide sides of the shell are squeezed together by suitable means to eject the liquid backwardly, thus producing a casting that is thinner that the shell from the first stage. This design is generally limited to casting thicker strip at lower speeds.

In the style of machine which may be called a converging gap machine, the distance between the two wide sides decreases as the casting proceeds through the machine so that the free sides of the two sheets are eventually pressed and welded together before exiting the caster. Heretofore, cross-sections of the casting pool have been generally rectangular in this arrangement, with the wide sides of the casting being parallel at any cross-section.

An example of the latter is the Bessemer twin-roll concept which features two juxtaposed and counter-rotating casting rolls with their parallel axes of rotation in a common horizontal plane. These rolls contain the sides of a pool of molten metal and the two downwardly moving cast sheets solidifying therefrom which are welded together and exit at the narrow gap (the minimum distance or "nip") between the rolls.

The ends of the pool must be blocked against metal outflow with stationary surfaces, and this presents a problem as metal tends to freeze on them. Also, the rolls must not warp in a way that will affect the constant gap thickness across the width of the strip, and if solidification is less than complete at the nip or at some portion thereof, excess liquid may come through, while total solidification before the nip either spreads the rolls or tends to jam the machine.

Recently the twin roll concept has seen extensive development, but for various reasons it and other designs aimed at casting highly refractory and relatively pure metal strip have met with difficulty and have not as yet found extensive commercial use.

A preferable two-sided casting machine concept would be a two-sided converging gap machine with a sufficiently wide and deep pool into which steel can be poured, and in which the end containment problem is obviated, the mold surfaces are not thermally overstressed and do not warp, and the two separately cast sheets are held together at a constant spacing for a finite time until the final solidification that welds them together is completed.

An important feature of continuous casting machinery is the texture of the casting surfaces. Conventional stationary (albeit oscillating) strand casting mold surfaces are generally smooth and are lubricated with a flux or fusible mold powder so that the casting will slide on them. For mold surfaces that move with the casting, smooth lubricated surfaces are no longer necessary, and knurled, scored, dimpled and other surface treatments have been applied to promote freezing uniformity.

Since the temperature of a mold casting surface rises as it extracts heat from the casting, the surface has a tendency to expand although this expansion is mollified by the rigidity of the mold structure. At the same time, the casting as it grows thicker tends to contract, the result being that the casting tries to break away from the mold. This may happen unevenly so that certain areas may remain in better contact with the mold than others, resulting in uneven heat transfer over the surface of the one-sided casting which then gets thicker in some spots than in others. Again, gasses can be released from a metal as it solidifies which may also lead to uneven heat transfer.

A matter of concern with all moving mold casting machinery is the cyclic heating and cooling of the mold which is most severe at the mold surface. If the mold surface is backed by a thick structure, the interior of which sees relatively little cyclic temperature change, then the growth of the surface material on heating which would occur if the surface were free to expand is restrained and the surface material is forced to forge into itself compressively. In the cooling part of the cycle this material then restretches and after many of such cycles may crack, resulting in a pattern of uncontrolled and undesirable connected fissures (called heat checks) on the mold surface. Various forms of expansion slots to control this unwanted casting surface working have been defined in the patent literature.

SUMMARY OF THE INVENTION

It is an object of this invention to provide a strip casting apparatus which circumvents the difficulties cited above and which receives liquid steel from a conventional tundish and pouring tube, open stream, or other and casts a wide and essentially fully solidified strip of approximately constant fractional centimeter thickness at a velocity exceeding one meter per second. This strip may be rolled to hot band gage or less with a minimum of conventional rolling equipment or used directly with no further rolling, and may have embossings on the surface which may be subsequently rolled out.

Further objects of the invention are to furnish a means of dynamic adjustment of the cross-sectional shape of the cast strip, to provide a relatively thin and light-weight mold construction which will see a minimum of thermal stress during thermal cycling, and to hold the surface of the strip while it is being formed so that the self-stretching of the freezing metal due to restrained thermal contraction will be essentially uniform across the casting surface.

Also, since the downwardly moving strip exiting the machine is thin and easily bent to a small radius, the mold need be suspended only a few feet above ground level as compared to the greater height of conventional strand casting equipment.

Since this invention produces a thin two-sided casting at a high discharge speed and at a temperature considerably above that desirable for direct rolling, the strip may be cooled by appropriate heat absorbing apparatus such as a bank of waste-heat boiler tubes prior to its delivery to the first rolling stand, the invention thus providing opportunity for further energy savings over and above that afforded by apparatus producing slower and thicker castings which require soaking furnaces with positive heat input prior to the first rolling stand.

These and other objects and attributes are achieved by my invention as hereinafter described. Although this description refers to steel as the material being cast, it is to be understood that the invention may be applicable to other materials as well.

The apparatus, hereinafter called a mold or a machine is for the casting of wide and thin metal strip having two wide sides and two narrow edges, and consists in part of a generally vertically oriented casting cavity that contains a pool of liquid and the enveloping casting solidifying therefrom. The center portion of the surface of this cavity is broad at the top and narrows both with depth and also as the narrow ends of the pool surface are approached, horizontal cross-sections of the pool having a cigar or a canoe-like symmetrical shape or a skewed spindle like shape (having playing card symmetry) that becomes narrower as the section is taken further down the mold. Some distance from the bottom the two sides become essentially parallel to each other and are spaced apart at a distance essentially equal to the thickness of the strip being cast, this space being the casting gap, or "nip".

The casting cavity has at every elevation an essentially constant peripheral dimension, so that its width increases somewhat as the thickness of the central region decreases with advancing depth of the pool.

The actual shape of the casting cavity of the invention is a many-facetted approximation of the smooth cavity just described, each wide side of which is formed by a plurality of contiguous facets which are the mosaic-like elements of the casting surface and which may have either smooth or dentate top and bottom and/or side edges. These facets are the surfaces of thermally conductive elements that I call plates, that are separated from each other by narrow fissures.

The plates on each side of the machine are arranged in a number of nearly vertical columns that are juxtaposed in a successively contiguous manner to form an array of rows and columns that describe a checkerboard or a staggered checkerboard pattern and which approximate a doubly curved surface. I call this warped mosaic-like surface a matrix. Two such matrices face each other and form the wide sides of the mold cavity.

For clarity in the following description I use the terms top, bottom and side edges of the plate to mean the upper, lower and vertical side edges of the plate as it sits in the matrix.

The plates may be rectangular or of other such geometrical shape that they can nest together and be subdivided into separable columns.

The number of columns and number of plates in each column of the two matrices facing each other are desirably large so that the obtuse angle between plates of adjacent columns is always close to 180 degrees thus minimizing the local unbending of the casting in the vicinity of the fissures as the casting proceeds downwardly through the mold. The width of the fissures between plates is small but not necessarily constant.

The narrow edges at the sides of the casting cavity are delimited by liquid metal containment means formed either by protuberances appended to the plates on each end of the matrix, or by independent downwardly moving edge blocking means which may take the form of an endless chain of blocks which abut or run between the edges of the matrices. The blocking means need not extend to the full length of the cavity as an outflow of liquid metal is there prevented by the recently solidified edge of the casting itself.

In operation, the four casting surfaces move downwardly and at a common velocity with the casting as it solidifies from the sides of the relatively stationary (albeit turbulent) liquid pool. A continuous supply of plates is required at the top of the mold cavity to replenish the casting surfaces, and a continuous removal of plates must occur at the bottom as they are stripped away from the casting. The plates of each column of the matrix are therefore only a portion of a larger number of plates that may take the form a train or circuit so that plates leaving the bottom of each column of the matrix are carried upward to feed plates to the top of the mold via a suitable smooth path. The plates of one column are not necessarily the same width as those of another.

The plates of each column are integral with or supported by plate carriers which are fastened serially together to form a loop by articulated or flexible connecting and pulling devices such as the links of a chain or a length of flexible material. These plate carrying elements run in or on an arcuately contoured running surface of a track affixed to the frame of the machine that not only holds the column of plates to its appropriate orientation in the matrix but in some embodiments may guide the train of plates through some portion of its return path, the loop of track being sometimes interrupted or supplemented by driving and auxiliary guiding means for the train of plates and carrier elements.

The centerline of the arcuately grooved guiding surface of this partial loop of track is in general a smooth three-dimensional space curve with either zero or positive (convex) outward curvature.

The loops of plates diverge away from each other after leaving the matrix at the bottom, and reconverge before they reenter it at the top.

The basic machine consists of two assemblies of looped trains of plates, a portion of each assembly forming a matrix with the two matrices facing each other. The assemblies of these trains are supported by the guiding and driving devices that are mounted on a machine frame consisting of two stationary structures which pass through the two sets of trains.

Each of these structures is affixed to a machine base via stancheons at one or both ends. The base is made in two parts which can be moved apart to a fixed distance from each other to separate the two train assemblies to the desired casting gap and thus establish the casting thickness.

Alternately, by spring-loading the two matrices together with the casting gap at zero thickness before starting the machine and providing a stop so that maximum desired strip thickness will not be exceeded, the machine may be started without the use of a strip of starter sheet that plugs the opening at the bottom. Here the spreading force of the growing casting gradually opens the gap to the desired casting thickness as the casting cavity fills with liquid metal.

Sprockets, sheaves or other driving wheel means for the columns of the matrix of each side of the machine are mounted on and keyed to a common head shaft at the bottom of the matrix, and the two head shafts for the two sides of the machine are driven in synchronism albeit in opposite directions.

The machine is preferably operated at a speed such that a liquid center of the strip extends outwardly to the casting thickness as formed on the narrow edges of the casting cavity throughout the entire upper converging section, so that the final welding together of the two sheets occurs almost entirely in the lower constant thickness section.

It is well known from experiment as well as from the theory of surface tension that liquid metals that have small wetting tendency for a given mold material will not penetrate small fissures of less than ½ of a millimeter in width in a mold surface if the mold temperature is much below the solidification temperature of the liquid metal.

To provide a stable matrix that is impenetrable to liquid metal and that can take up localised thermal expansion and minimize the effects of thermal bending, the articulated plates of the mold are separated from each other by small fissures. The width of these fissures must be great enough to accommodate the surface expansion of each plate and yet be small enough so that hot metal will not penetrate the fissure. This width although small is not necessarily constant.

However, the large thermal expansions incurred in casting higher melting materials such as steel require the plates to be so small (so that fissures required for plate expansion are not too wide) that the number of columns and rows of moving plates to cast a reasonable width of strip at a desirable speed becomes unreasonably large. Therefore in an embodiment where any dimension of the plate surface is much larger than one centimeter, the use of larger plates with the surface subdivided by expansion joints is employed. I call these expansion joints "slits".

This larger plate may be formed either of a single piece, one side of which is subdivided into blocks by narrow slits a fraction of a centimeter deep, or of a number of discrete casting blocks of a few millimeters in thickness attached to a tray by intervening stems of small cross-section.

The latter construction provides a region between the back of the blocks (i.e. the side opposite the casting face) and the tray for the flow of coolant so that the temperature of the back of the blocks and the tray may be held to a low value during casting by cooling the underside surface of the blocks during their upward return path and in some cases during their downward travel through the lower regions of the matrix. In the one-piece design, drilled or machined passages may be provided to serve the same function.

If thick blocks without stems are used, they are made of such thickness that the flow of heat will not penetrate the full thickness of the block until such time as the block has traversed the matrix. Here the blocks are affixed directly to or are integral with the tray.

The blocks that comprise each plate may be square and nest together in a checkerboard or staggered checkerboard fashion, or may be hexagonal and nest in a honeycomb fashion.

Other embodiments exist in which the plate surface is comprised of closely-fitting blocks of other shapes or of blocks which are not all of the same shape.

The term plate will hereinafter be used to indicate the total assembly of blocks and tray, however configured.

The width both of the slits and of the fissures must be great enough to accommodate the surface expansion of each block and yet be small enough to obviate penetration by hot metal. Both the fissures between the casting plates and the width of the slits between the blocks are preferably less than 0.5 mm and the slits are spaced at intervals that are preferably on the order of one centimeter or less.

The edges of the blocks may be chamfered or otherwise contoured so that a grid of ridges are formed on the casting surface. The grooves resulting from the chamfers are wide enough at the top to be penetrated to a sizable portion of their total depth by liquid metal.

The material cast in the grooves working in conjunction with metalostatic pressure serve as a latticework of keys to prevent appreciable relative lateral sliding of portions of the casting surface as the casting forms on the mold surface.

In this way elongation due to restrained shrinkage that occurs over a wide expanse of surface as the material solidifies and cools is not concentrated in one place resulting in possible localised necking and rupture, but is spread out evenly over the surface. The connected grid of ridges on the casting surface is rolled out later if a flat product is desired. The grooves are typically only several millimeters deep. In another embodiment, the chamfers are eliminated, so that only the fissures of less than one-half millimeter in width remain between the blocks.

The mold may have a built-in mechanism to alter the cross-sectional shape (called the profile) of the strip by dynamic adjustment during casting. This is done in a preferred embodiment with shaft-mounted eccentric cams in the lower straight portion of the machine so that the tracks can be elastically deflected a small distance inwardly or outwardly by turning one or more horizontal shafts on which the cams are mounted.

In one such arrangement a number of circular cams, one for each track and of equal diameter but with varying amounts of eccentricity, are mounted on a common shaft on one side of the machine and so arranged that each cam in turning pushes the track toward (and thus thins) or pulls the track away from (and thus thickens) the casting in the local vicinity. In general, several such cam shafts are required for at least one side of the machine.

So that the profile of the strip may be varied continuously from a full center to a full edge condition, (i.e. thicker at the center or thicker at the edges), the eccentricity of these cams is greatest for tracks at the center of the casting cavity and decreases to zero for those at the edges so that a quarter turn of a cam shaft in one direction (or the other) moves the adjacent portion of the matrix of plates from a locally plane configuration to one that is inwardly (or outwardly) bowed. The magnitude of the cam adjustments is desirably small.

Other devices than cams can be used to vary the local distance of the opposite mold walls from each other such as horizontal elastic beams on which the raceways are mounted and which can be bowed inwardly or outwardly by appropriate bending moments applied to the beam ends, or, individual adjusting screws or hydraulic cylinders can be employed to set the local position of each track, the latter design allowing complete independence in the adjustment of the tracks.

On each of the two sides of the machine the tracks, the track positioning devices and the shafts and bearings for the various driving and guiding sprockets or sheaves are held in place by attachment to frame members. One of the two frames is slidably mounted on a rigid machine base so that it may be moved toward or away from the other to adjust the casting thickness and may also in certain embodiments be slidably mounted in a right angled direction so that it may be moved laterally with respect to the other frame so as to adjust the width of the cast strip.

During the normal running of the machine, a short distance occurs between the point of first contact of the downwardly moving plates at the top of the matrix with the meniscus of the liquid metal pool and a point further down where cooling water may first be applied to the underside of the blocks. Application of water to the casting face of the blocks is delayed until the return side of the loop. The timing of first water application is such that water will not find its way through the fissures before solid steel has formed on the surface of the matrix, else dangerous spitting (explosive evaporation of water) may occur.

By not overcooling the plates with the water sprays so that some residual heat remains on the plate casting surface before it re-contacts liquid metal at the top, spitting due to residual water on the plate surface is avoided. Alternately, other evaporating methods such as a blast of warm gas directed at the plate surfaces at the top of the machine may be employed.

By virtue of their regular distribution over the casting surface, the grooves and to some extent the fissures and slits act as an even deployment of casting surface irregularities. These cause local variations in the thickness of the cast sheet due to the enhanced or diminished local heat transfer. These variations (which tend to occur randomly on castings when no grooves are present) may thus be given a periodic regularity. By a small increase in the width of the casting blocks at the edge of one side of each matrix and a small vertical offset of one matrix relative to the other, the thin places on the casting on one of the two opposing matrices may be made to generally intermesh with the thick places being cast on the other, thus promoting a more regular freezing of the strip.

In approximating a non-developable doubly-curved mathematical surface with a mosaic of closely nested contiguous plates, several types of anomalies or imperfections in the approximation may occur. These are in general a function of the local curvature and the change in curvature from point to point of the surface being approximated, the size of the plates, and certain design parameters which are defined below.

These anomalies include

1) A step anomaly, in which the displacement of some portion of a plate is further from the smooth surface being approximated than the adjoining portion of an adjacent plate.
2) An offset anomaly in which adjacent plates of a given row may be offset vertically from each other.
3) An offset anomaly in which plates of a given column may be offset sidewardly from each other.
4) A taper anomaly in which the gap between adjacent plate edges is not of constant dimension.
5) an enlargement of the normal gap between the plates of a column due to the plates being pivoted at some distance below the casting surface and the curvature assumed by the column in traversing the matrix.

To minimize these anomalies (which disappear in the lower straight section of the mold), a preferred mold design utilizes a large number of rows and columns and a minimal curvature and changes in curvature of the surface being approximated. Also a preferred construction utilizes tracks with circular arcuate grooves, the arc center lying in the plane defined by the root of the chamferred grooves in the plate surface.

The loops of plates forming the matrix may be supported by the tracks in various ways, two of which are 1) one-ended suspension in which one vertical edge of a plate is fitted with a round bottomed roller or sliding protuberance, the edge opposite being supported with one or more lugs that interlace with recesses in a plate of an adjacent column.
2) a two-ended suspension in which both vertical edges of the plate are fitted with round bottomed protuberances which conform to and slide on a portion of the arcuate grooves of the tracks.

The chain tension (and pressure from the casting) seat the rounded plate protuberances in the (straight or convexly bent) arcuately grooved tracks backing the matrix, the plates thus being positioned and guided by the tracks and pulled by the chain.

In the return regions of the loop, the train of plates may be carried by the chain or cable only, except for places where driving, tightening or positioning wheels, sheaves, or sprockets provide support. Alternately, where roller chains are used, tracks may be used to support most of the loop circuit.

Although in its simpler forms the machine is arranged to cast a single width, designs are possible in which the width is adjustable. In a non-adjustable design, horizontal cross-sections of the pool have regions in which the jointed surfaces of the two matrices approximate curves that are preferably everywhere concave or flat against the casting. This allows all of the loops of plates which may diverge from each other on leaving the bottom of the machine to be of the same length and to re-converge at the top to reform the matrix without interfering with each other.

In width-adjustable designs, horizontal cross-sections of the pool have certain regions in which the jointed bounding curves are convex against the casting so that certain of the loops of plates as they reenter the matrix at the top must be longer so as to pass over adjacent loops without interference.

To accommodate the three-dimensional space curvature required for the typical loop of plates, the flexible pulling device (typically a chain or a cable) that carries each loop through its circuit is not only required to bend in the direction of vertical curvature of the matrix but will, depending on location, also see a certain amount of twist as well as some small amount of sideward bending and/or link-to-link sideward displacement.

It is desirable that this twisting and bending be minimized in the design for the pulling device to operate smoothly and not experience unreasonable wear. Again, a mold with a converging section that is many plates high and and wide and of a low aspect ratio (small maximum pool thickness/width) is preferred. Such construction also minimizes the slight dynamic distortions of the casting itself as it proceeds downwardly between the two matrices.

Several specific embodiments of the invention are described in the following drawings. However, it should be obvious to those skilled in the art that the scope and spirit of the invention is not limited by the particular embodiments cited and that there are many possible casting element configurations and many ways of supporting and carrying the casting elements which can achieve the purport of the invention, the essence of which is a pair of downwardly moving matrices of closely proximate casting plates each forming the facetted approximation of a doubly-curved surface, two such matrices facing each other so as to converge from a centrally wide-mouthed hot metal entry area to an essentially constant width exit area of a length sufficient for essentially complete solidification, and which along with suitably blocked edges define a casting cavity for the production of cast strip.

DETAILED DESCRIPTION OF THE DRAWINGS

Figure 1:
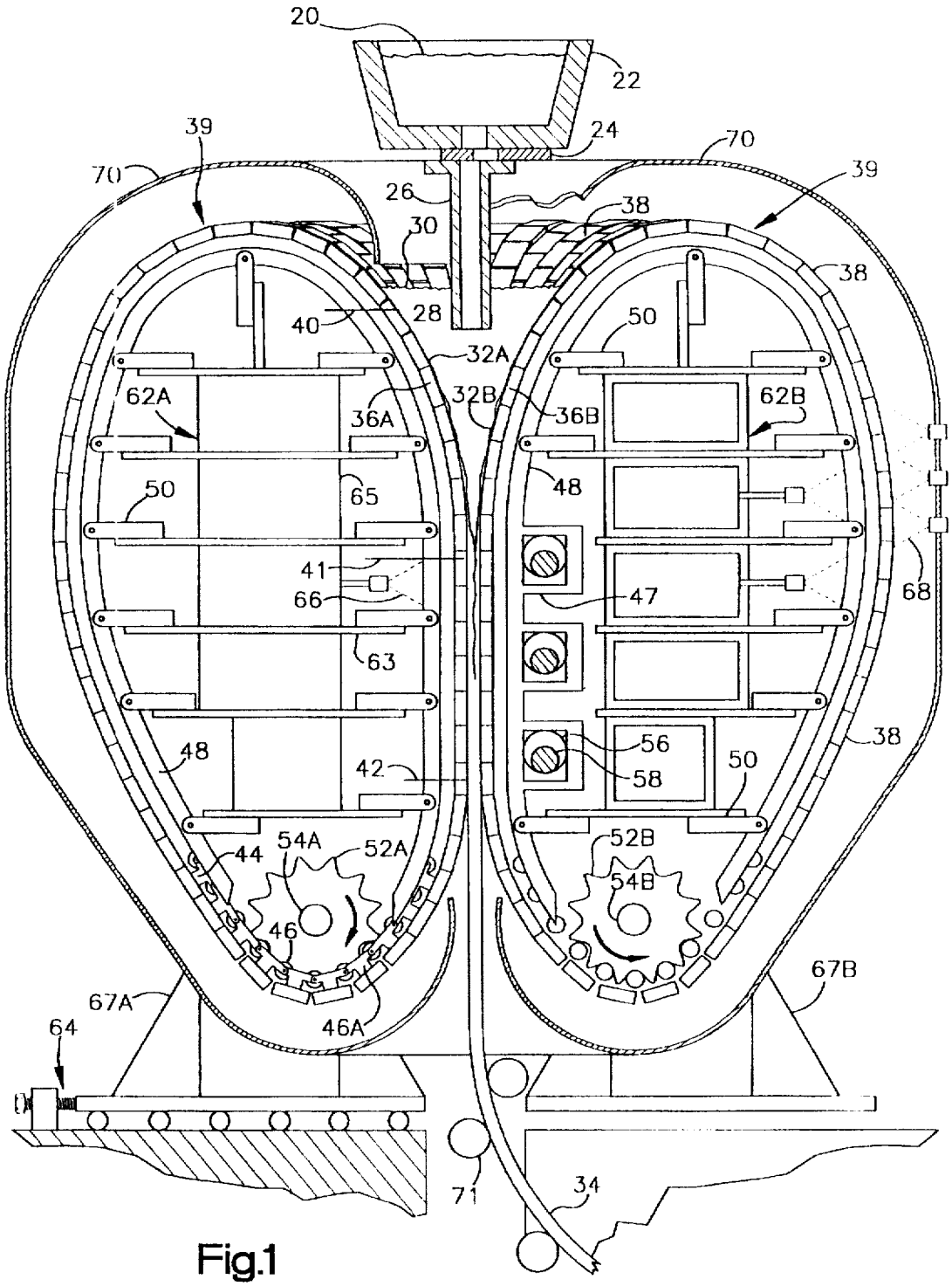
FIG. 1 is a cross-sectional elevation of an embodiment using a roller-chain taken through the center of the casting machine.

FIG. 1 is a schematic cross-sectional elevation taken through the centerline of a machine embodiment which utilizes a roller chain with arcuately contoured rollers 46*a*. Liquid metal supply 20 held by tundish 22 is fed through flow regulating slide gate 24 and pouring tube 26 into pool 28. The pool has surface 30 and continuously solidifying sidewalls 32*a*–32*b* which thicken as they move downwardly to form casting 34.

The pool and nascent casting are constrained on both sides by downwardly moving portions 36*a*–36*b* of continuous loops 39 of contiguous casting plates 38. Portions 36*a*–36*b* are arranged in adjacent rows to form a reservoir impenetrable to liquid metal. This consists of a converging section 40–41 where solidification begins and a straight section 41–42 where it is completed. Plates 38 of loops 39 are constrained to move in the desired path by plate carriers 44 supported by barrel shaped rollers 46 of roller chain 46*a*.

Rollers 46 run in arcuately grooved tracks 48 that are attached to machine frame plates 63 in appropriate angular orientation by clamps 50.

The ends of the tracks 48 pay chain 46*a* onto and off of ganged sprockets 52*a*–52*b*. There is a sprocket for each chain loop and the sprockets for each side of the machine are mounted on common drive shafts 54*a*–54*b*. These are turned in synchronism by a drive mechanism (not shown) in the directions indicated thus imparting motion to the chains.

Cams 56 mounted on through cam shafts 58 are rotatable to make small adjustments in the cross-sectional shape of the casting by locally flexing tracks 48 inwardly or outwardly by a slight amount in the general region 41 to 42. Extensions 47 to the tracks 48 box in the cams so that they can move the center tracks inwardly or outwardly to change the shape of the casting. Shafts 58 are mounted on bearings (not shown) which are rigidly affixed to frame members 62a–62b. Cams may be provided on either side or on both sides of the machine.

Frame members 62a and 62b are formed of a stacked assemblage of plates 63 and rectangular closed end tubes 65 and are affixed to vertical stancheons as at 67a–67b on either end of the machine. Tubes 65 may also serve as conduits for cooling water.

Frame member 62a may be moved a small distance toward or away from frame member 62b by mechanism 64 or by a spring and stop arrangement not shown to adjust the strip thickness or maintain the machine.

Water jets as at 66 supported on frame 62a–62b are located so as to cool the inside of plates 38 during an emergency stopping of the machine and also optionally during normal operation as required. Water sprays shown typically as 68 mounted on water and spray containment boxes 70 are located so as to cool the casting side of plates 38 during their upward return travel.

Solidified casting 34 is led from the bottom of the machine by guide rolls 71 into conventional flattening and reducing rolls or to a coiling device.

Figure 2:
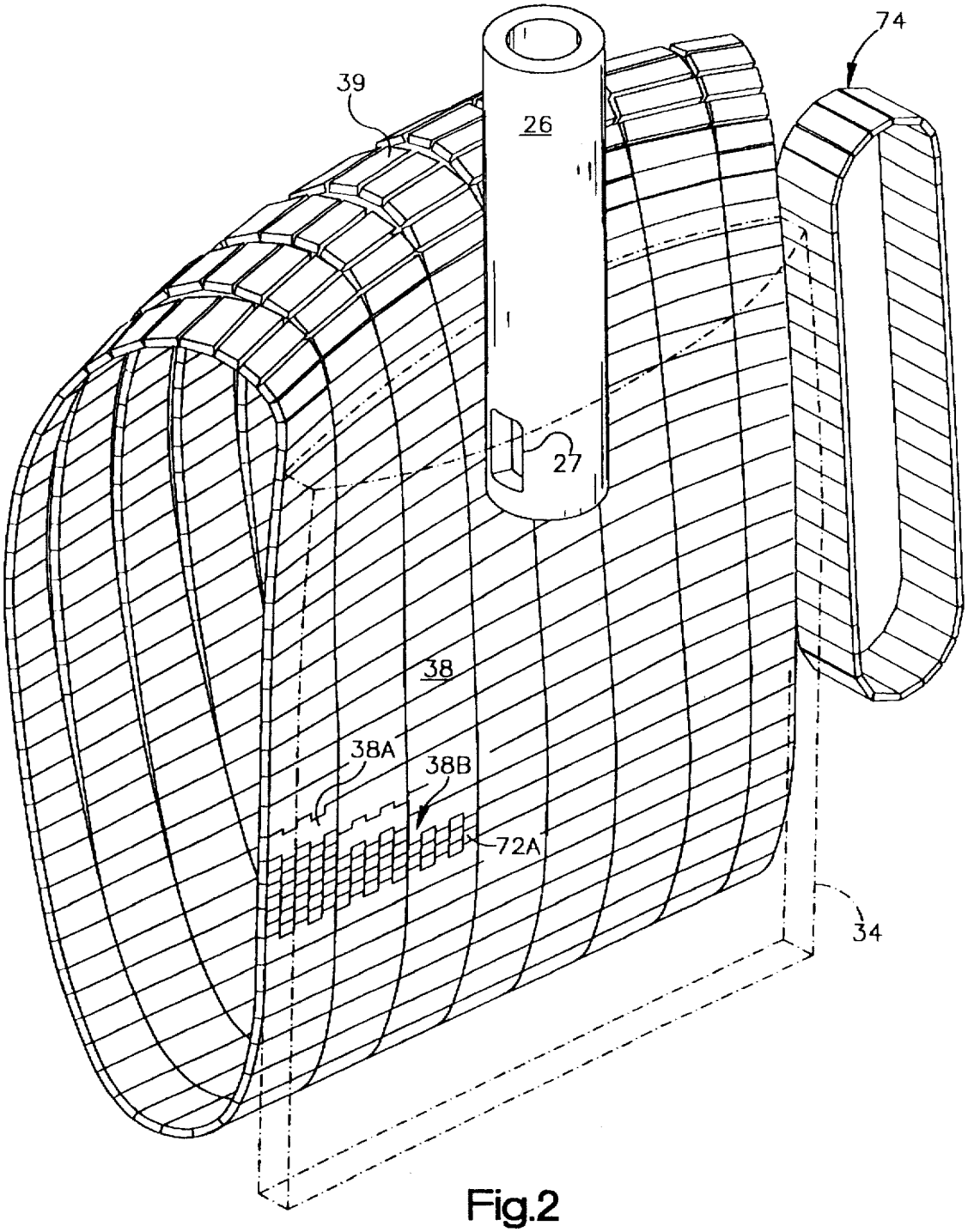
FIG. 2 is a schematic of the spatial arrangement of the loops of plates and feeding tube of the casting machine with plates of the near half removed and the casting pool shown in phantom.

FIG. 2 is a conceptual schematic cutaway of one half of a machine embodiment in which all parts have been omitted except the hot metal feeding tube 26 (shown in part) with lateral discharge holes 27 and the loops 39 of casting plates 38 and train of end containing blocks 74. The casting width is not adjustable in this embodiment. For clarity of presentation, the plates 38 are shown as plain one-piece rectangles except where marked 38a and 38b. At 38a a plate that is sub-divided into blocks is shown in outline, here with dentate top and bottom edges. At 38b it is shown with its surface in full detail as consisting of an assemblage which here has ten square blocks 72a, five wide by two high. The plates may either be juxtaposed so that the blocks are staggered or arranged in a straight checkerboard pattern.

The pool 28 and the resulting casting 34 contained by the machine is shown in phantom. Each end of the pool is contained by an endless train of end blocks 74.

Figure 3:
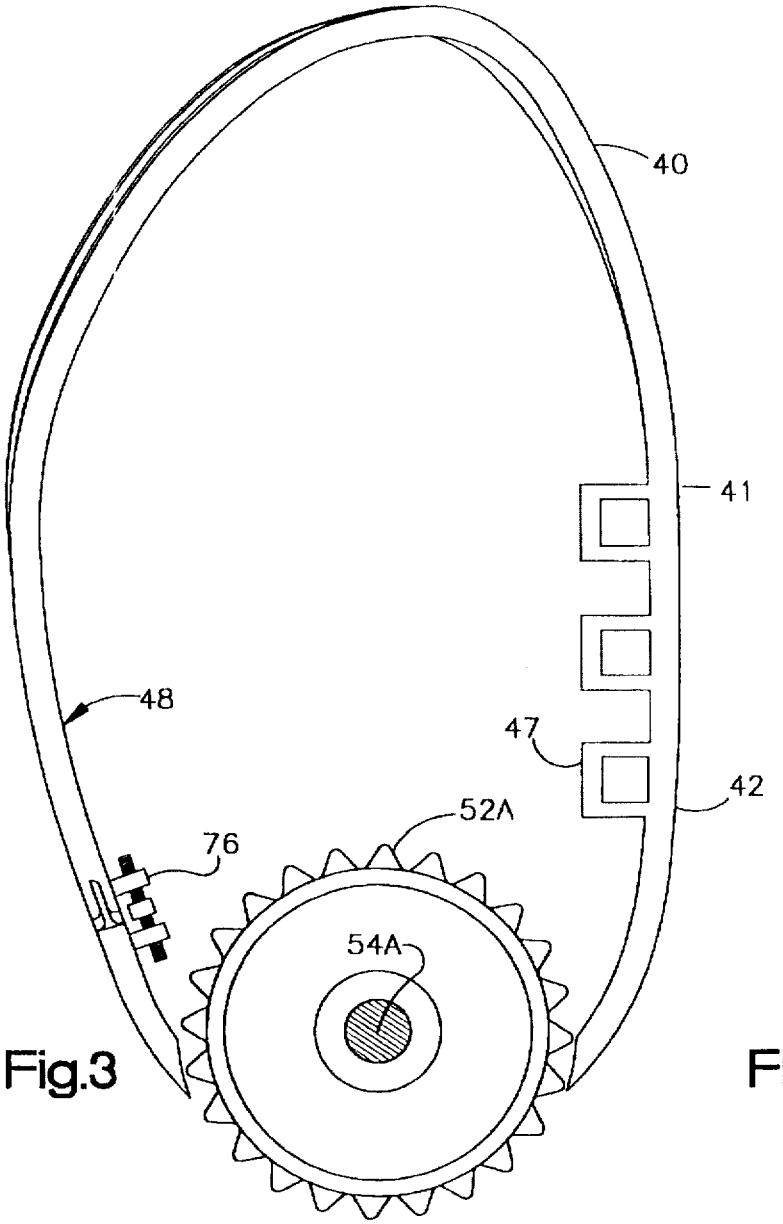
FIG. 3 is a side-elevational view of an arcuately grooved track showing a three-dimensional twist.
Figure 3A:
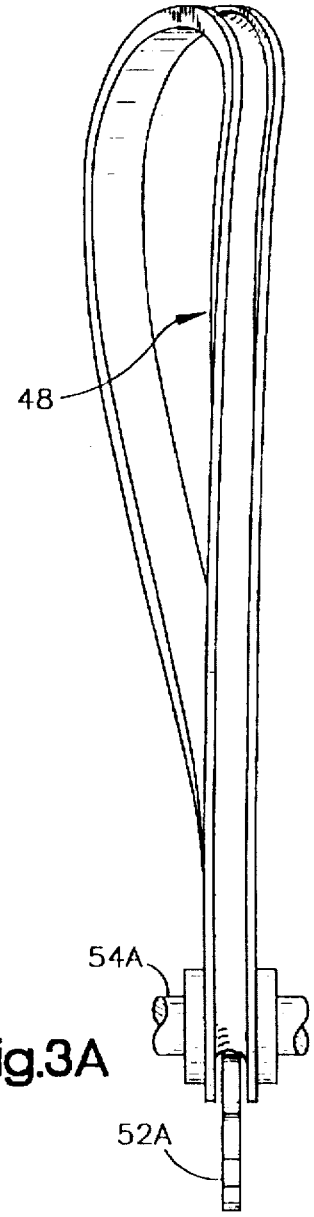
FIG. 3A is a front-elevational view of the track of FIG. 3.

FIG. 3 shows a side elevation and FIG. 3A shows a front elevation of a single arcuately grooved track 48. Taken together the figures illustrate exaggeratedly a typical three dimensional track curvature required to a greater or less degree by a number of such tracks for positioning a matrix of plates carried by barrel shaped roller chains on each side of the mold.

All but one or more straight tracks that may be used in the center of the machine and the tracks supporting the end blocking plates have some three dimensional curvature, the amount and direction of which may vary depending on the position of the track in the machine and other design parameters.

A track lengthening device 76 is used to tighten the chain. Cam box extensions are shown at 47.

An embodiment employing a different chain guiding method than that of FIGS. 3 and 3A is shown schematically in FIG. 4 in which again only half of the machine is depicted. Here roller chains in loops represented by lines 46a carry plates 38 and are guided by tracks 48 only in the region in back of the matrix. The chains are otherwise positioned by the top idler sprockets 80 which are separately bourne by free running bearings here shown on bent axle 81, and by the chain tightening sprockets 82. The chains are driven by ganged sprockets 52a keyed to head shaft 54a. Separate bearing mounting brackets not shown may be used in place of bent axle 81. A continuous loop of end blocking plates 86 are supported and driven similarly to the plates of the matrix by idler sprocket 88 and driving sprocket 90.

FIGS. 5A, 5B, 5C, 5D are schematic horizontal cross-sections taken at the top of the pool and showing different pool surface shapes and end containment means.

Figure 4:
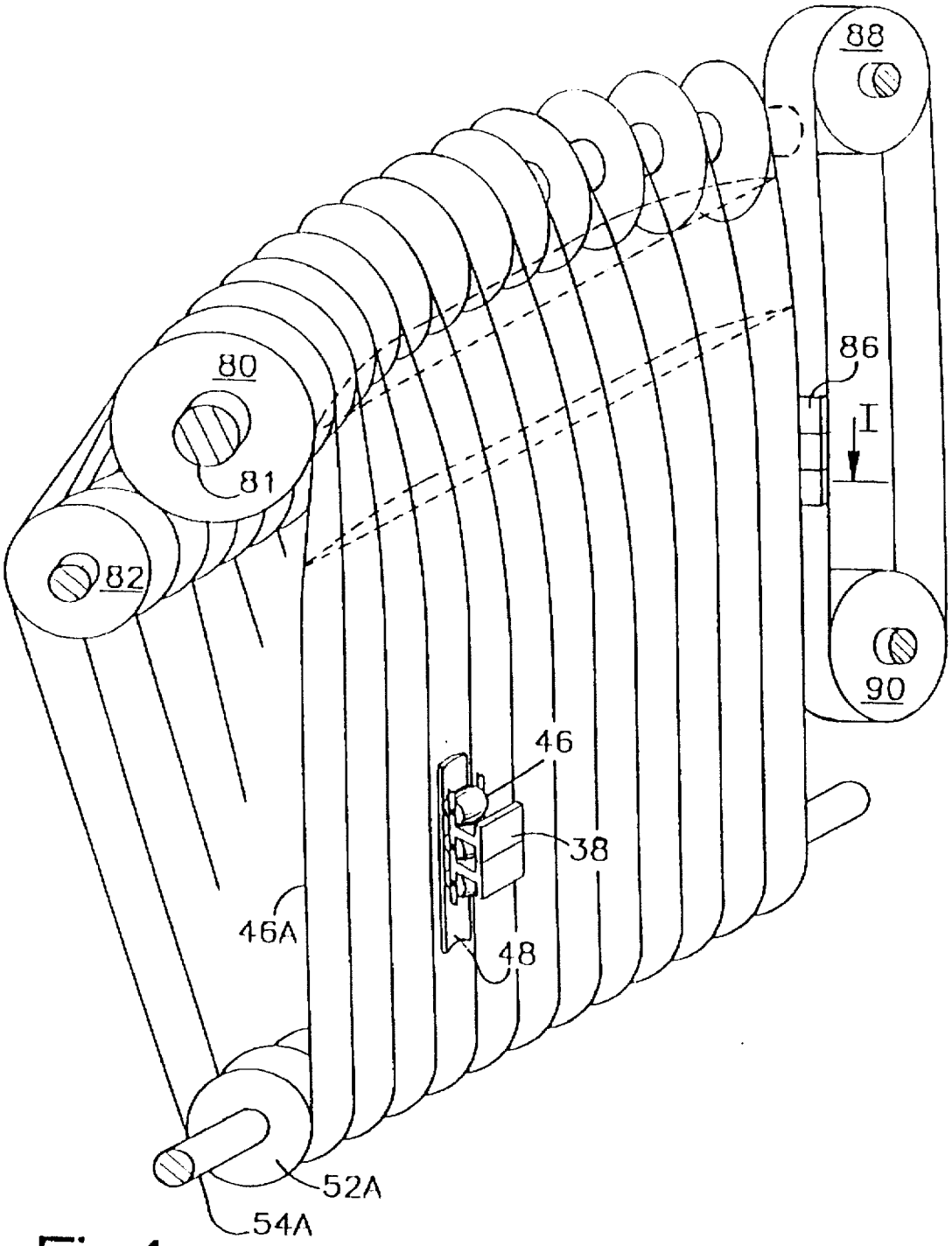
FIG. 4 is a schematic showing an embodiment in which portions of the tracks of FIG. 1 are replaced with guiding sprockets and unguided spans.
Figure 5A:
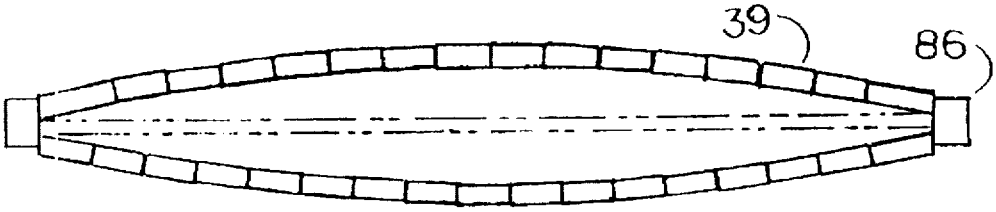
FIGS. 5A, 5B, 5C, 5D are partial horizontal cross-sections of various embodiments of the machine taken at the elevation of the pool surface.
Figure 6A:
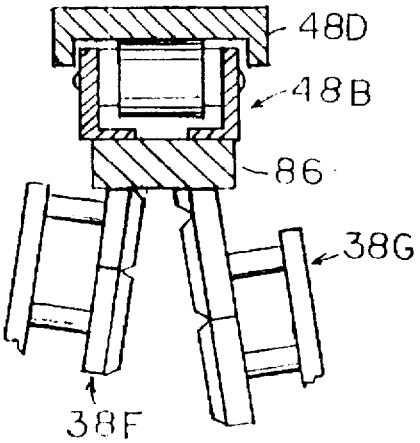
FIGS. 6A, 6B, 6C, 6D are partial sections similar to those of FIG. 4A showing alternate methods of end containment in detail.

FIG. 5A shows a pool that is similar to that shown in FIG. 2 and FIG. 4 with end blocking that is the partial section taken at I of FIG. 4, one end of which is also shown in FIG. 6A. Here the adapted mold plate assemblies 38f and 38g at the outer edge of the matrix are shown abutting one of the blocks 86 of train 74 as in FIG. 2. Blocks 86 are carried on links of adapted roller chain 48b which runs in stationary track 48d supported by framework not shown. The casting cavity converges to the constant casting thickness indicated in the center of the drawing.

Figure 5B:
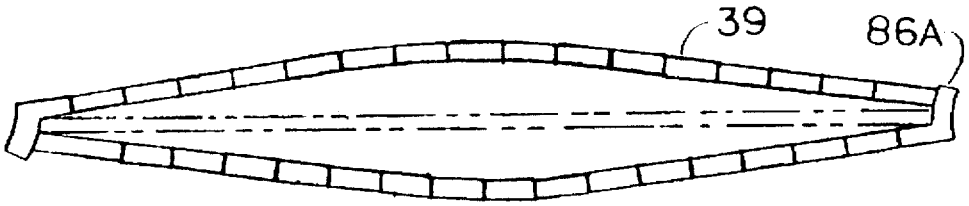
Figure 6B:
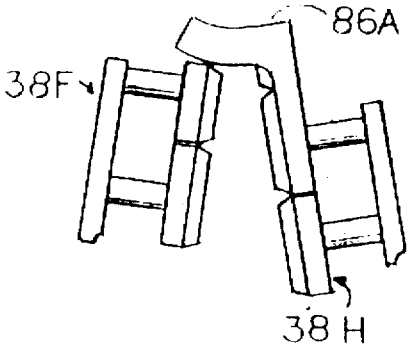

FIG. 5B shows a somewhat different pool surface shape and a method of casting edge containment using an appendage 86a to the otherwise standard casting plate 38f thus forming special end plate 38h as also shown in FIG. 6B. The embodiments of FIGS. 5A and 5B allow for casting thickness adjustment, but not for casting width adjustment.

Figure 5C:
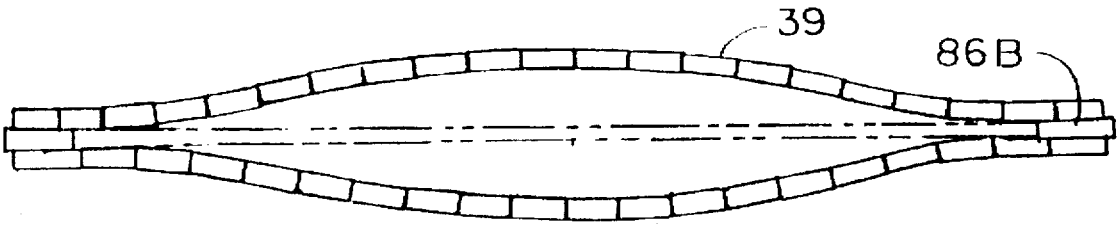
Figure 6C:
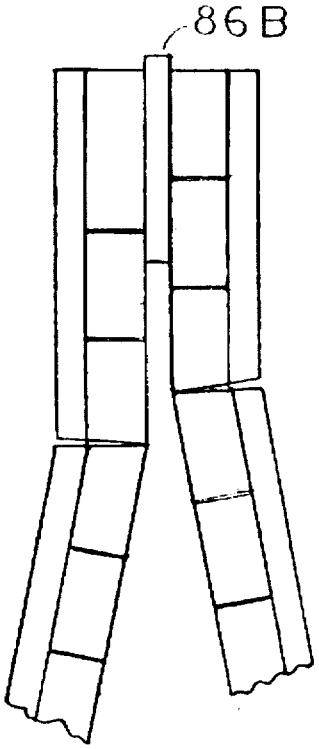

FIG. 5C illustrates a casting pool surface boundary that has both convex and concave boundary portions so that the pool containing matrices converge to parallel condition at the edges of the strip. The width of the casting can be changed by attaching individual edge dam blocks 86b as shown in FIG. 6C to the plates of one of the columns of the matrix on each end at various distances from the center of the cavity. The casting plates are here shown as comprised of solid blocks without coolant passages, which design is permissable if the time in the matrix is relatively short and the return portion of the loop is long enough to ensure adequate cooling of the plates.

Figure 5D:
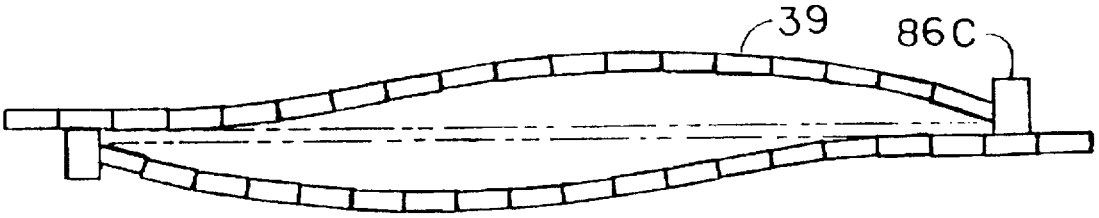

FIG. 5D shows a pool shape adaptable to changing both the casting width and thickness. The two matrices facing each other are of reversed (playing card) symmetry and have both concave and convex regions fairing into a flat region at opposite ends, the other ends terminating in an end blocking chain. To adjust the casting width, one whole matrix and end blocking train assembly 74 is shifted laterally with respect to the assembly opposite to adjust the casting width. The thickness is varied by moving the matrices together or apart. The plates are shown here with subcutaneous coolant passages.

Figure 6D:
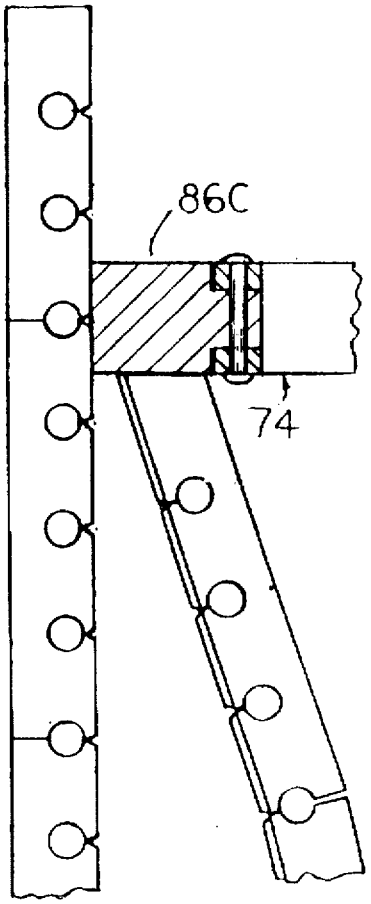

FIG. 6D shows the edge blocks 86c which are in a continuous train 74 here shown at right angles to the edge blocking train of FIG. 6A, and which may be employed in a width adjustable embodiment.

Figure 7:
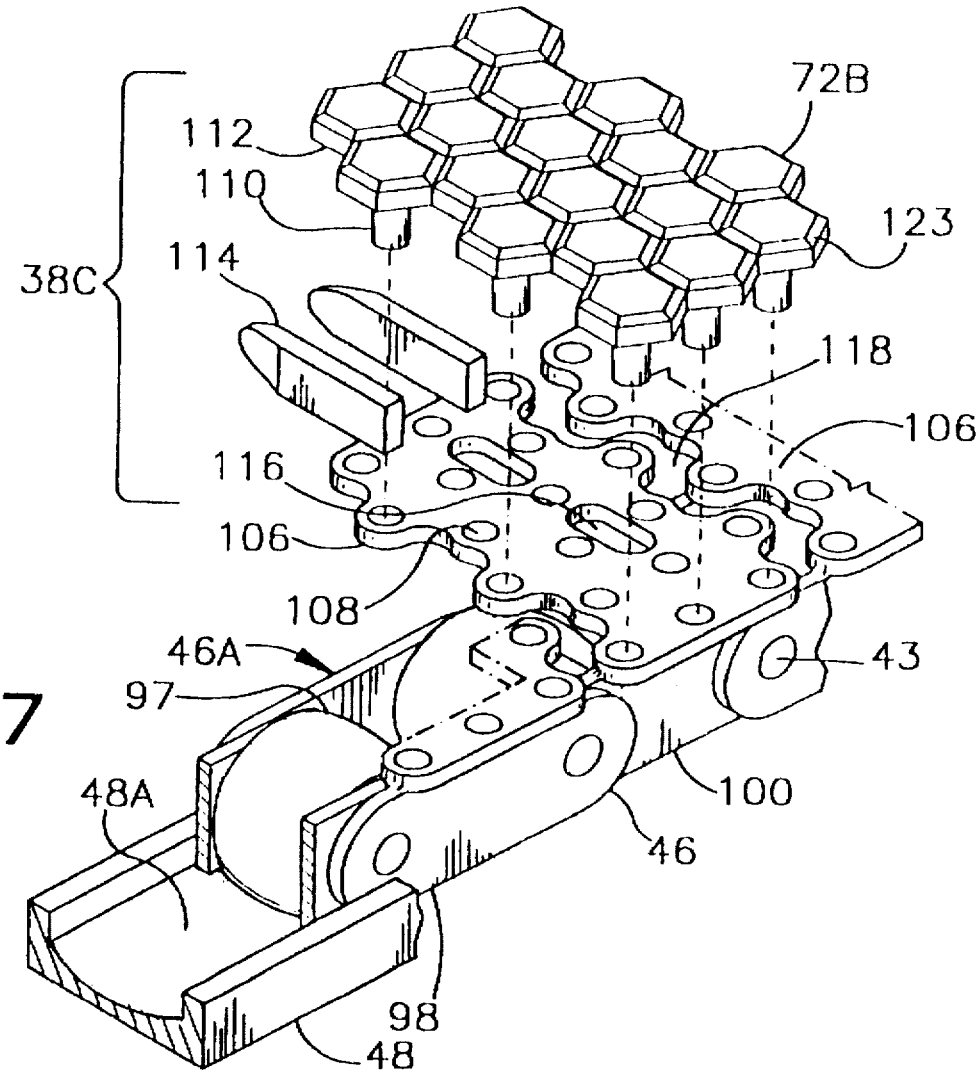
FIG. 7 is an exploded view of several plates, trays and carrier elements of one embodiment of the invention using a sprocket chain with arcuately contoured (barrel-shaped) rollers.

Details of an embodiment of the invention which utilizes a roller chain running in a channel track as described in FIGS. 3 and 3A is shown in FIG. 7 in an exploded view. The several links 46 of chain 46a are adaptations of a conventional large roller conveyor chain with side plates 98 of the (wider) pin links, and side plates 100 of the (narrower) roller links. Barrel shaped chain rollers 97 run on arcuately contoured surface 48a of track 48.

In this embodiment, tracks may support the entire loop of plates except that portion engaging the drive sprocket, or may support the loops of plates only in the region of the matrices, the balance of the loops being carried around the rest of the circuit by driving, idling and tightening sprockets as in FIG. 4.

The several parts of casting plate 38c are spaced apart for clarity of presentation. Casting blocks 72b with chamfered edges 123 are each comprised of a hexagonal head 112 and a stem 110. Tray 106 has holes 108 which receive the ends of stems 110 of casting blocks **72*b* which are affixed to the tray. Locating lugs 114 mesh loosely with spaces under the heads 112 and between the stems 110 of blocks 72*b*** in the adjoining column of plates. Clearances are provided in this loose meshing so that plates in adjacent columns can twist slightly with respect to one another as they travel downward through the matrix.

Slots 116 and open spaces between adjacent trays 118 are provided to allow water to enter and leave the region between the heads of the blocks 112 and the trays 106.

Figure 8:
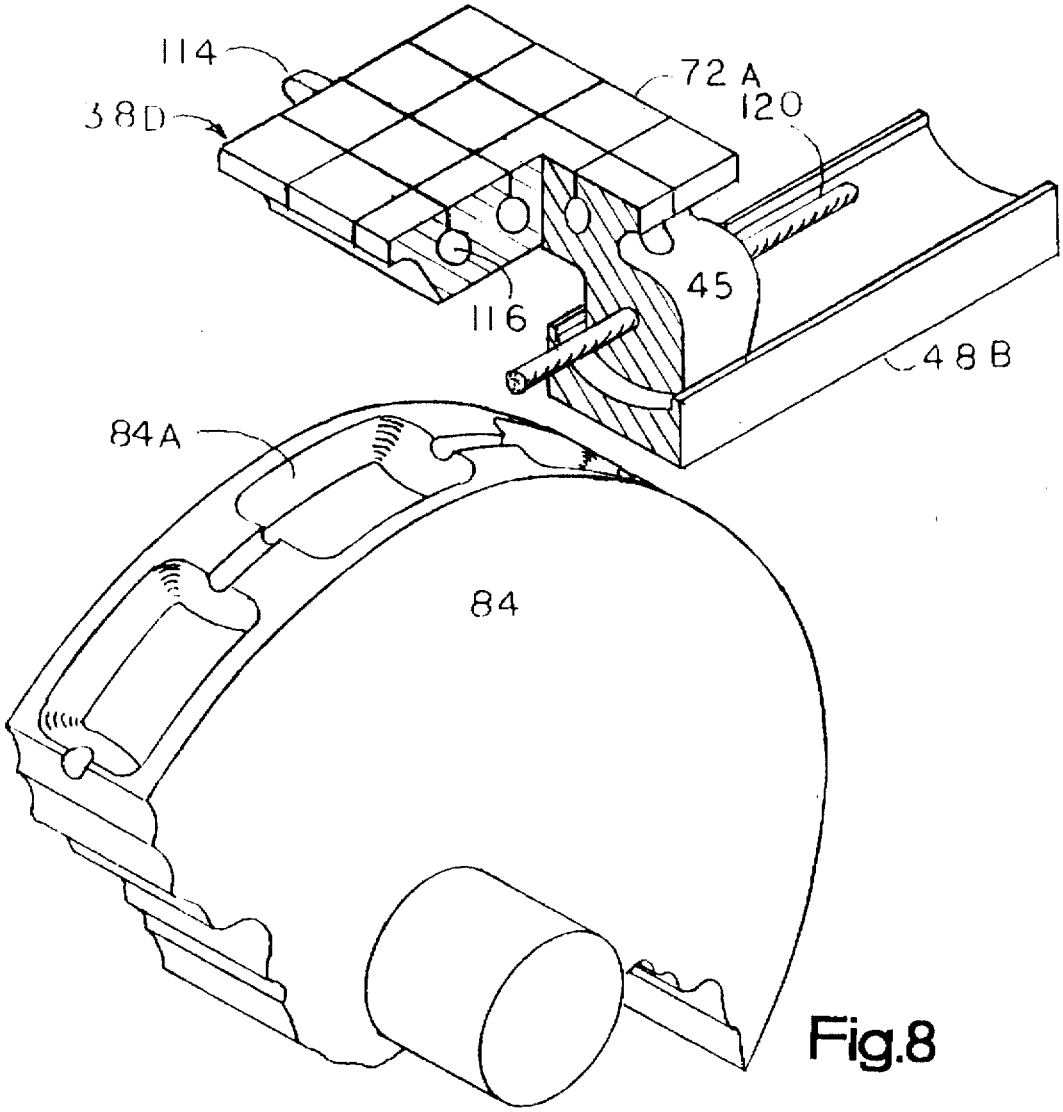
FIG. 8 is a cutaway showing an embodiment with casting elements connected by a steel cable approaching an adapted pocket sheave.

Another embodiment which employs a flexible member such as a cable or wire rope 120 rather than a roller or other chain is detailed in FIG. 8 which is a cutaway of one plate carrier element 45 approaching its driving pocket sheave 84 with pockets **84*a* in which elements 45** nest.

Figure 8A:
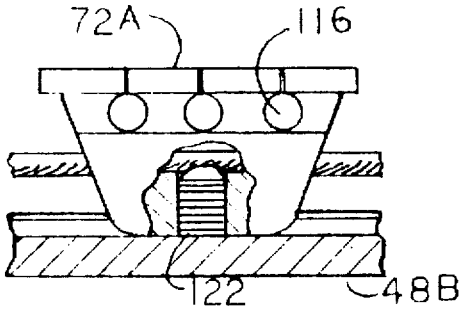
FIGS. 8A and 8B show orthogonal views of the elements of FIG. 8.
Figure 8B:
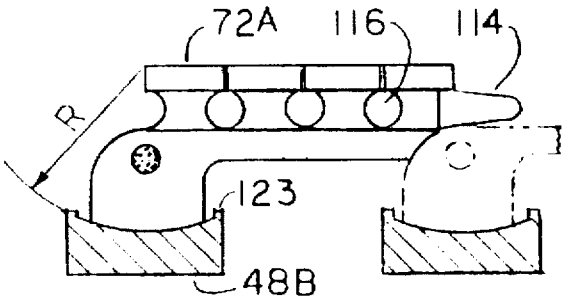

FIG. 8A is a section through the track centerline of this embodiment, and FIG. 8B is a cross-section at right angles to the track **48*b*. Track 48*b* here is a circular arcuate trough with rotation limiting curbs 123. The distance of the axis of rotation of the plate 38*d*** (as indicated by radius R) from the plate surface is essentially zero.

Track **48*b* in conjunction with the round-bottomed carrier element 45 guides the train of plates 38*d*** so that the vertical edges of the plates of any given column are all tangent to a common smooth three dimensional curve.

Plate **38*d* is here shown formed of integral square casting blocks 72*a* with subcutaneous coolant passages 116**.

Plate carriers 45 are strung on cable 120 at equal spacing and are affixed to the cable by set screws 122. Locating lugs 114 assure approximate alignment between the plates of adjacent columns. Holes 116 provide water passages for cooling the backs of the casting blocks.

Here the tracks **48*b* support the loops of plates only in the region of the matrices, the balance of the loops being carried around the rest of the circuit by driving, idling and tightening sheaves as in FIG. 4**.

Figure 9:
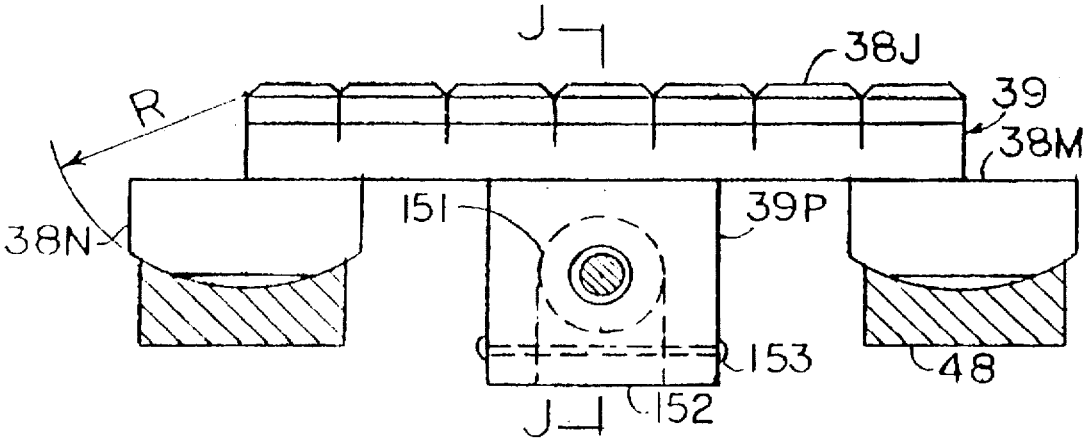
FIG. 9 shows an elevational view of an embodiment using a modified beaded chain in which the protuberances of the plates essentially cover the full width of the arcuately grooved tracks and are interlaced.
Figure 9A:
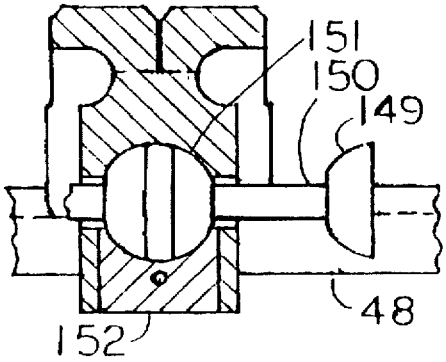
FIG. 9A is a cross-section of FIG. 9
Figure 9B:
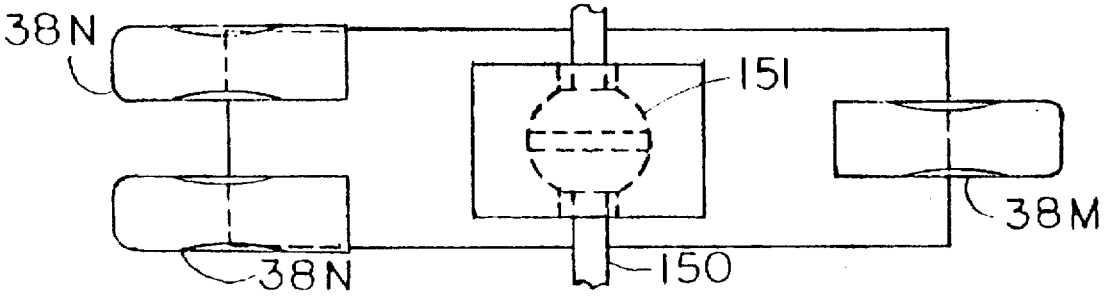
FIG. 9B is the bottom view of FIG. 9

FIG. 9 shows a sectional elevation of a different design of casting plate which is taken at right angles to two matrix supporting tracks. FIG. 9A is a cross-section of FIG. 9 taken at JJ and FIG. 9B is a bottom view of FIG. 9.

In this embodiment the plates 39 which include a seven long by two wide array of blocks **38*j* have circular arcuately radiussed protuberances 38*m* and 38*n* which slide on radiussed grooves in the tracks 48** and essentially cover the full width of the arcuately grooved tracks. The protuberances of adjacent columns loosely interlace with each other to align the rows of plates.

Here the plates 39 are connected and pulled by a modified form of beaded chain consisting of dumbbell shaped connecting elements 150, the partly spherical ends 149 of which seat in a spherical cavity 151 in an extension **39*p* of plate 39 and formed in part by shaped plug 152 that is pinned in place by pin 153. Here again the tracks 48 support the loops of plates only in the region of the matrices, the balance of the loops being carried around the rest of the circuit by driving, idling and tightening sprockets as in FIG. 4**.

Figure 10:
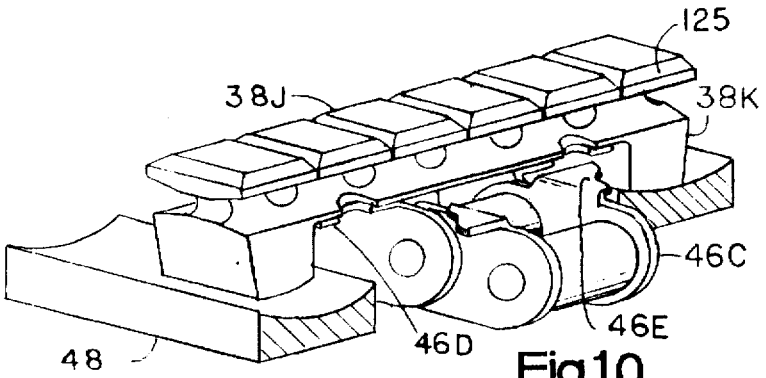
FIG. 10 shows an embodiment adapted for variable width using a roller chain, FIG. 10A showing an orthogonal view of same.
Figure 10A:
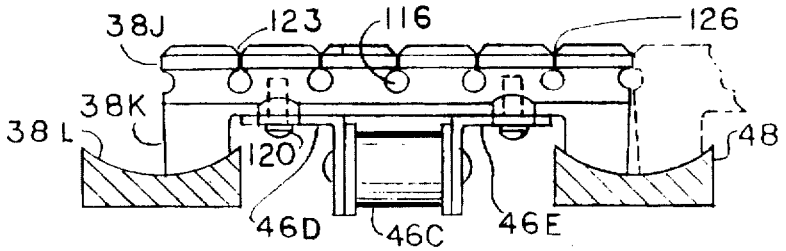
FIG. 10B shows a schematic plan view of several plates of the type shown in FIG. 10 assembled on arcuately-grooved tracks.

FIG. 10 and FIG. 10A show a plate and plate support arrangement where a roller chain **46*c* with side extensions 46*d* and 46*e* is attached to the underside of plate 38*j* by fasteners 120. Here again the rollers of the roller chain do not run in tracks, the plate being supported at both ends by protuberances 38*k* with radiussed surfaces, each of which run in a portion of one side of the tracks 48 with circular arcuate grooves 381 affixed to the machine frame. Again as in FIG. 8**, the axis of rotation of the plate about its side edge is essentially at the plate surface.

The series of plates, only one of which is shown, are pulled by roller chain **46*c***. Two links of the chain are shown, one in the foreground with its plate removed and with its side-plate extensions partly cut away.

Plate **38*j* here is shown as six blocks wide and one block high, each block having chamferred edges 125 which form notches 123, the bottoms of which fair into narrow slits 126 that in turn terminate in optional coolant passages 116 some distance below the plate surface. The chamferred edges 125 at the periphery of the plate form similar notches between adjacent plates of the casting matrix. Again as in FIGS. 7,8, and 9 the tracks 48 support the loops of plates only in the region of the matrices, the balance of the loops being carried around the rest of the circuit by driving, idling and tightening sprockets as in FIG. 4**.

Figure 10B:
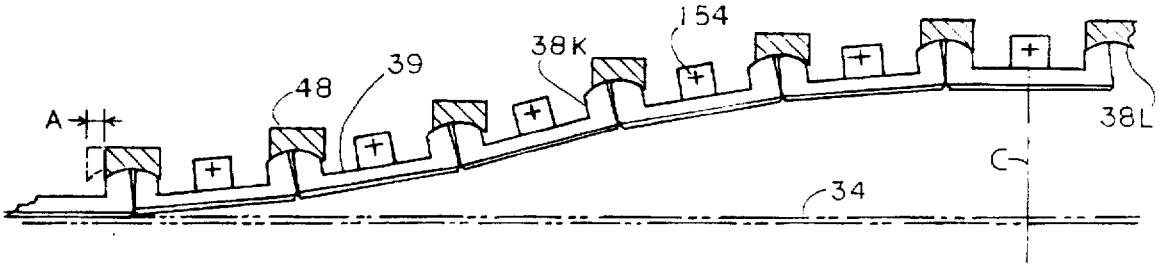

FIG. 10B is a schematic of a horizontal section taken through a portion of one of the matrices where the plates 39 are fitted with protuberances **38*k* at each end and suspended on tracks 48 as in FIG. 10 and FIG. 10A. The finished strip 34 and a line C indicating the center of the machine are indicated in phantom. The centers of the pulling chains, cables or other are indicated as at 154**.

The figure illustrates an advantage in machine construction that results from the arcuate grooves 381 in the track being centered at the casting surface, in that tracks 48 in the upper portion of the matrix require no twist to support the plates in their correct positions but require bending toward the centerline of the machine only, the bending occurring in the upper part of the tracks and being greater for tracks that are further from the center "C".

The amount of bending displacement between the lower part of one of the outer tracks (shown in phantom) relative to the uppermost portion of the same track is indicated by dimension "A".

By making the tracks wide enough to support the plates in their most twisted positions, and by centering the arcuate track grooves on the casting surface, twisting of the tracks in the vicinity of the matrix is not only avoided, but also the inward bending of the outer tracks tilts the inner edges of the plates of the outer columns downward which in turn tends to keep the plates of the matrix in even rows, thus mollifying anomalies 2) and 3) above.

Figure 11A:
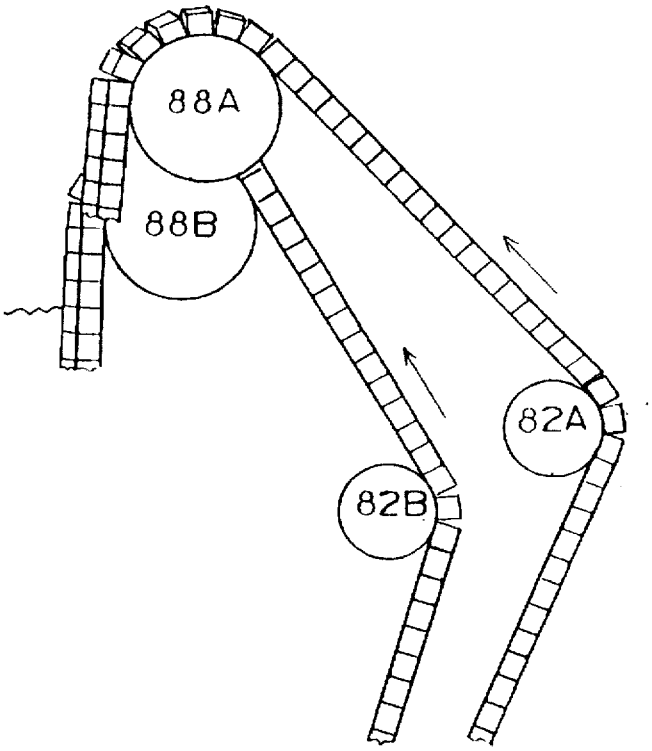
FIG. 11 and 11A are schematic views showing a chain cross-over scheme.
Figure 11:
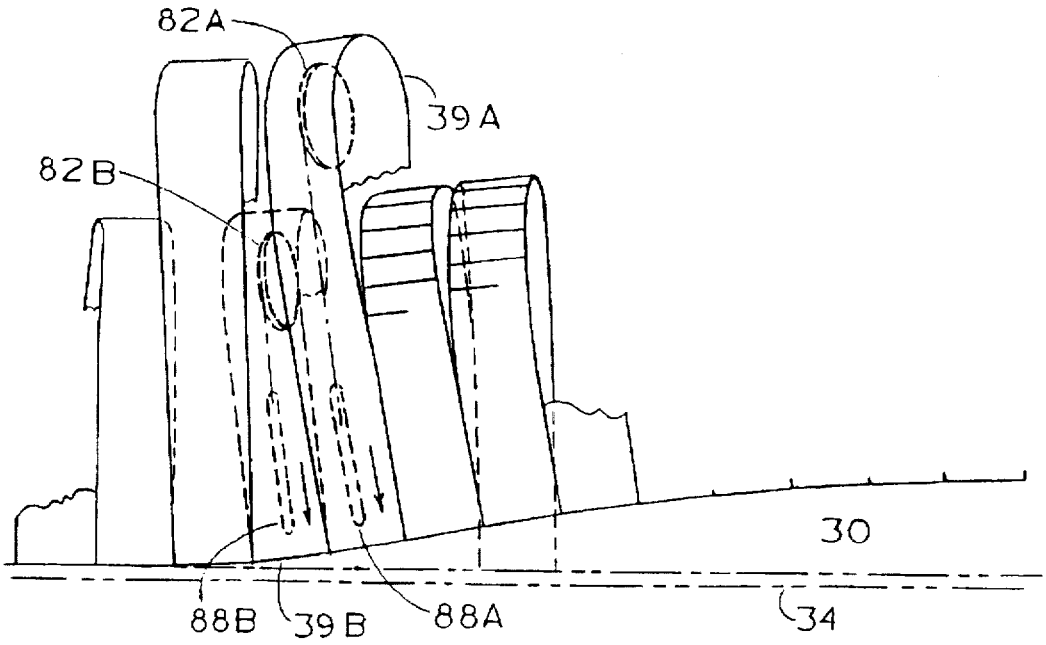

FIG. 11 is a schematic plan view of a portion of the top of the machine embodiment in which the general placement of loops of plates and carrier sprockets necessary to create a region of convex inward curvature at the top of the pool converging to strip 34 of constant thickness at the bottom is shown. Here the design is a modification of the arrangement of FIG. 4 involving three sprockets for each train, the modification being illustrated by two loops of plates **39*a* and 39*b* also shown in schematic elevational view by FIG. 11A. Loop 39*a* is carried in the direction shown in part by tightener sprocket 82*a* and thence over top idler sprocket 88*a*. By positioning sprocket 82*a* outwardly from typically positioned tightener sprockets such as 82*b* and by elevating top idler sprocket 88*a* above typically positioned top idler sprockets 88*b*, the loops of plates and their carrier chains can accommodate regions of horizontal convex-inward curvature of the matrix. Loops such as 39*a* are longer than typical loops 39*b***.

The same up and over loop positioning is required if the loops of plates are guided entirely by tracks but in any case can only be used where the columns of plates are not interlaced.

Figure 12:
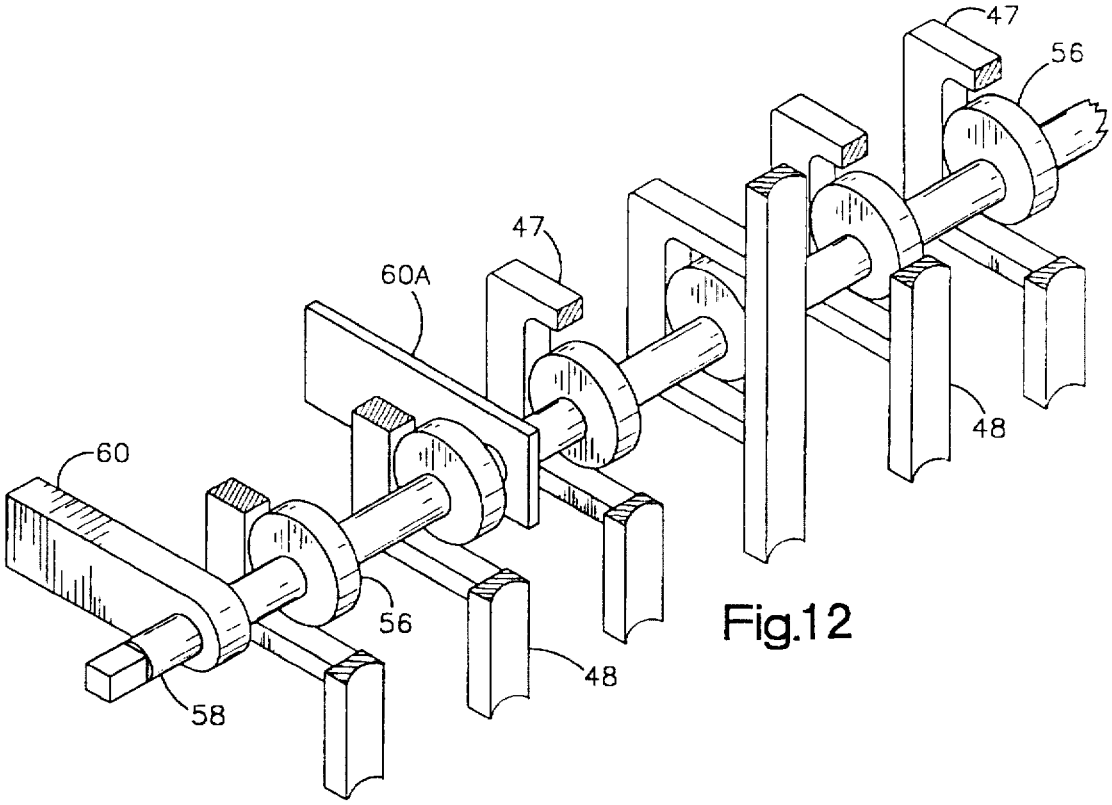
FIG. 12 shows a cutaway of a portion of a contour-adjusting cam shaft.

FIG. 12 shows a portion of cam shaft 58 bourne by main bearings 60 at each end and by intermediate bearings 60a, all attached to the machine frame. Circular cams 56 are disposed on shaft 58 so as to bear on tracks 48 at the three o'clock position of the cams.

The vertical portion of rack box extensions 47 bear on each cam face at the nine o'clock position. The cams on shaft 58 are mounted with varying amounts of eccentricity, being concentric at the ends and approaching a maximum eccentricity at the center. With shaft 58 in the neutral position (with the apogee of each cam at 12 o'clock), tracks 48 are all abreast of each other and lie in a plane. By turning shaft 58 clockwise, the plane is distorted, becoming slightly convex.

Turning the shaft in the opposite direction makes the former plane concave. By appropriate adjustment of the several cam shafts the cross-sectional shape of the emerging strip may be controlled to a flat, or if desired, a crowned condition. The eccentricity of the cams is exagerated for purposes of illustration.

Although the figures herein illustrate only several designs wherein centered and offset arrangements of chains and cables and supporting tracks are utilized, it should be obvious to those skilled in the art that many other designs which feature other types of track supported flexible or articulated means can be used to carry and position casting elements with various nested block arrangements that form two matrices, these along with end blocking means to delimit a variety of convergent pool shapes, all of which fall within the scope of the invention.

I claim:

1. A continuous strip casting machine comprising (a) two wide and downwardly moving casting surfaces facing each other, each of said surfaces being comprised of the faces of a plurality of closely nested casting plates forming in their aggregate a matrix, each said matrix being a facetted approximation of a smooth doubly curved surface, said matrices delimiting the two wide sides of a casting cavity that contains a pool of molten metal and a casting being continuously frozen therefrom, said doubly curved surfaces being so shaped that the surface of said contained pool has an elongated shape with a broad thickness at the center region which gradually converges to a narrow thickness at each end, said broader portions at the surface gradually diminishing in thickness with depth of said cavity so as to converge to a narrow and essentially constant thickness across the entire width of said pool at a distance below said pool surface thereby defining a converging section, said cavity also having a section of approximately constant thickness for an additional distance therebelow thereby defining a constant thickness section, and (b) two end containment means which retain the narrow edges of said casting and pool therein, and (c) means for positioning said plates of said matrix in a number of juxtaposed and nearly vertical columns, said plates of each column being a portion of a larger number of plates that comprise a closed and endless train of said plates, all said plates of each said train being mounted on or integral with plate carrying means, said plates and carrying means being serially connected with articulated or flexible connecting means to form a loop, and (d) driving means to advance said loops of said casting plates and solidified portions of said casting adjacent thereto downwardly at an essentially constant velocity, and (e) recirculating means for removing said plates from said downwardly moving casting and returning said casting plates from the bottom of said casting cavity so as to re-enter the matrices at the top, and (f) means whereby each of said trains of plates, carrying means, and connecting means are guided in a smooth three dimensional space curve at least in part by some combination of circular arcuately grooved tracks, idling wheel means, and driving wheel means which position and advance said casting plates both in their travel downward through said matrix and in a smooth and generally upward return path, said carrying means having one or more convexly radiussed sliding or rolling surfaces opposite the casting surface of the plates so shaped as to conform to concave radiussed grooves in stationary channel tracks which run parallel to the direction of plate travel and support said train of plates, said tracks having circularly arcuate grooves of essentially the same concave radius as said convex radius of the convexly radiussed plate carrying means, the center of said circularly arcuate grooves in said tracks being on or near said casting surface, said connecting means being bendable and torsionally deflectable so as to accommodate both bending and twisting of said loops of plates in forming a three dimensional space curve, and (g) cooling means to extract heat absorbed by said casting plates from said casting.

2. A casting machine according to claim 1 wherein said plate connecting means comprise the links of a sprocket chain of the roller chain type having large rollers the faces of which are rounded to a radius essentially equal to that of said track grooves, said rollers rolling in said grooves, and wherein said connecting means support one edge of said plates, the edge opposite being fitted with positioning and load transmitting protuberances which engage recesses in the columns adjacent during their said downward travel through said matrix.

3. A casting machine according to claim 1 wherein said plate connecting means are comprised of a continuous loop of flexible cable and said plate carrying means are round bottomed, being rounded convexly to a radius essentially equal to said concavely arcuate track grooves and which slide in said track in at least a part of said circuit, wherein said connecting means are attached to one edge of said plates, the opposite edge of said plates being fitted with positioning and load transmitting protuberances which engage recesses in the columns adjacent during their said downward travel through said matrix.

4. A casting machine according to claim 1 wherein both vertical edges of said plates comprising the said two matrices are supported by circular arcuately radiussed protuberances running in said tracks, said tracks being circular arcuately grooved to accommodate said radiussed protuberances and said plates or carriers thereof being serially connected.

5. A casting machine according to claim 4 wherein said radiussed appurtenances of both sides of said plates are truncated in width and of such shape that said loop of downwardly moving plates of a given column can enter the space between the columns of the matrix adjacent on either side of said given column from a position above said adjacent columns, the edges of which said given column then abut the proximate edges of said loops of plates of said adjacent columns without interference of said edges or protuberances so as to accommodate a casting cavity with both convex and concave horizontal boundary portions.

6. A casting machine according to claim 1 wherein said casting surfaces of said plates are each comprised of the outer surfaces of one or more closely nested casting blocks, said blocks being mounted on or integral with a carrier tray such that a fissure of a width less than one millimeter exists everywhere between the adjacent edges of adjoining blocks of a given plate, and where said columns of said plates and said plates of each column are juxtaposed such that spaces between the edges of the surfaces of adjacent plates in the said matrix measure everywhere less than one millimeter.

7. A casting machine according to claim 6 wherein said casting blocks are relatively thin and are spaced from said carrier tray by mounting means of smaller cross-sectional area than the surface area of said plates, thus providing space for the introduction of coolant between said blocks and said tray and partial thermal isolation of said tray from said blocks.

8. A casting machine according to claim 6 wherein said casting blocks are relatively thick and are attached directly to or integral with said tray.

9. A casting machine according to claim 4 wherein the edges of the faces of said casting blocks facing said casting are chamfered, radiussed or otherwise contoured to provide tapered grooves into which said molten metal of the pool partially enters before solidification.

10. A casting machine according to claim 1 wherein said tracks are deflectable in the vicinity of said lower portion of said casting cavity by adjustment means so as to adjust the cross sectional profile of said casting.

11. A casting machine according to claim 10 wherein said adjustment means comprise cams mounted on manually or power driven cam shafts.

12. A casting machine according to claim 1 wherein all horizontal cross sections of said pool are essentially bounded by segmented approximations of curves that are everywhere essentially flat or concave inward.

13. A casting machine according to claim 1 wherein all horizontal cross sections of said pool are bounded by straight line segment approximations of curves having both concave outward portions and concave inward portions resulting in a smooth transition to straight line portions at each end of said casting cavity, said straight line portions confronting each other at a separation distance equal to the casting thickness and being held to said spacing by laterally positionable end containment means.

14. A casting machine according to claim 1 wherein said horizontal cross sections of said pool are bounded by straight line segment approximations of curves having both concave outward portions and concave inward portions, said cross sections being skew or playing card symmetric about the centerplane of said strip, each long side of said cross-section having an end containment means abutting the edge of a segmented approximation of a concave inward portion, this portion fairing into a segmented approximation of a concave outward portion and this portion fairing into a straight portion, said straight portion being held contiguous to the end blocking means of the long side opposite.

15. A casting machine according to claim 1 wherein the said two wide casting surfaces facing each other are mounted on separate frames, at least one of said frames being horizontally movable in a first direction relative to the other so as to increase or decrease the thickness of said cast strip.

16. A casting machine according to claim 15 wherein one said machine frame is horizontally translatable in a second direction from the other and at right angles to the first direction so as to increase or decrease the width of said strip.

* * * * *